US007587798B2

(12) United States Patent
Michalon et al.

(10) Patent No.: US 7,587,798 B2
(45) Date of Patent: Sep. 15, 2009

(54) WIDE NONWOVEN AND THE PROCESS AND MACHINE FOR ITS MANUFACTURE

(75) Inventors: Andre Michalon, Tresserve (FR); Frederic Noelle, Saint Nazaire les Eymes (FR)

(73) Assignee: Rieter Perfojet, Montbonnot (FR)

( * ) Notice: Subject to any disclaimer, the term of this patent is extended or adjusted under 35 U.S.C. 154(b) by 283 days.

(21) Appl. No.: 11/568,521

(22) PCT Filed: May 9, 2005

(86) PCT No.: PCT/FR2005/001138

§ 371 (c)(1),
(2), (4) Date: Oct. 31, 2006

(87) PCT Pub. No.: WO2005/121428

PCT Pub. Date: Dec. 22, 2005

(65) Prior Publication Data

US 2008/0045107 A1 Feb. 21, 2008

(30) Foreign Application Priority Data

May 11, 2004 (FR) ..... 04 05077

(51) Int. Cl.
*D04H 1/46* (2006.01)
*D04H 5/02* (2006.01)
*D06C 3/00* (2006.01)

(52) U.S. Cl. ..... 28/104; 28/107; 28/122; 28/165; 26/51; 26/99; 26/101

(58) Field of Classification Search ..... 28/104, 28/105, 103, 107–115, 106, 116, 122, 165, 28/166, 167; 26/72, 73, 87–93, 96, 97, 99–106, 26/51, 18.6; 156/148, 229, 494, 496; 264/175, 264/288.4, 289.3, 290.2
See application file for complete search history.

(56) References Cited

U.S. PATENT DOCUMENTS

| | | | | | |
|---|---|---|---|---|---|
| 3,485,706 | A | * | 12/1969 | Evans | 28/105 |
| 3,501,565 | A | * | 3/1970 | Kalwaites et al. | 26/93 |
| 3,508,308 | A | * | 4/1970 | Bunting, Jr. et al. | 28/104 |
| 3,747,161 | A | * | 7/1973 | Kalwaites | 28/105 |
| 4,377,889 | A | * | 3/1983 | Tatham et al. | 28/112 |
| 4,446,189 | A | * | 5/1984 | Romanek | 28/107 |
| 4,883,709 | A | * | 11/1989 | Nozaki et al. | 28/104 |
| 5,136,761 | A | * | 8/1992 | Sternlieb et al. | 28/104 |
| 5,151,320 | A | * | 9/1992 | Homonoff et al. | 28/104 |
| 5,729,878 | A | * | 3/1998 | Kurihara et al. | 26/101 |
| 5,983,469 | A | * | 11/1999 | Beaty et al. | 28/167 |
| 5,996,195 | A | * | 12/1999 | White et al. | 26/88 |
| 2006/0014464 | A1 | | 1/2006 | Noelle | |
| 2006/0090315 | A1 | * | 5/2006 | Fleissner | 28/104 |

FOREIGN PATENT DOCUMENTS

| | | | |
|---|---|---|---|
| EP | 0786428 | A1 | 7/1997 |
| FR | 2846013 | A1 | 4/2004 |

* cited by examiner

*Primary Examiner*—Amy B Vanatta
(74) *Attorney, Agent, or Firm*—Pearne & Gordon LLP

(57) ABSTRACT

The machine for the production of a nonwoven comprises an expanding device which is arranged in-between a first consolidation by water jets and a second consolidation.

7 Claims, 2 Drawing Sheets

WIDE NONWOVEN AND THE PROCESS AND MACHINE FOR ITS MANUFACTURE

The present invention relates to nonwovens and the processes and machines for their manufacture. It relates more precisely to very wide nonwovens, having widths greater than 5 m for machine outputs of more than 200 kg per hour and per meter.

Generally, light nonwovens, from 15 to 80 g/m$^2$, known as "dry-processed" products are formed by carding and/or by airlaid techniques. However, for large manufacturing widths, that is to say for widths greater than 3.5 m, carding is the only dry processing technique used for high outputs.

It has been known for a very long time how to lap the carded web(s) transversely so as to form a very wide heavy lap, then to draw it in the machine (longitudinal) direction so as to reduce its weight per m$^2$. This technique is very limited in terms of speed and cannot produce very wide light nonwovens having a weight per m$^2$ below 60 g/m$^2$, while at the same time having output levels of 200 kg/hour and per meter of width, or more.

Modern techniques make it possible to construct carding machines having a maximum width of 5 m and delivering fiber webs having a maximum width of 4.7 m. Beyond the great technical difficulties of constructing drums of great precision in lengths of 5 m or more, these carding machines do not make it possible to produce fiber webs having low weight per m$^2$, with machine-direction to cross-direction strength ratios below 3.5.

It is particularly beneficial for the usual applications of nonwovens in the hygiene, medical application or clothing fields to have properties in the machine direction and in the cross direction that are as close to one other as possible.

The invention is aimed at a novel, very wide light nonwoven, produced by the "dry processing" technique and having a machine-direction to cross-direction strength ratio below 3.5.

A light nonwoven, and it is this that is the subject of the present invention, and the processes and machines for its manufacture have been found which make it possible to produce nonwovens by "dry processing" at high outputs, with large widths and having a ratio of a mechanical property in the machine direction, and especially tensile strength, to this same property in the cross direction below 3.5 and generally between 1.5 and 3.5.

One subject of the invention is therefore a nonwoven having a width of at least equal to 5 m, a weight between 15 and 80 g/m$^2$ and preferably between 30 and 60 g/m$^2$, and comprised of fibers having a length of at least 15 mm and preferably a length between 20 and 60 mm, of filaments or of a mixture of such fibers and filaments, characterized in that the ratio of a mechanical property, especially tensile strength, in the machine direction to this same property in the cross direction is less than 3.5.

Preferably said ratio is below 3 and better still, below 2.5.

The fibers and/or filaments may be made from plastic, thermoplastic, especially polyolefins such as polypropylene or polyethylene, or polyester or polylactic acid, polyvinyl alcohol, polyamide or a synthetic textile material such as viscose or a natural textile material such as cotton, linen, wool and wood. The web may comprise different layers.

Another subject of the invention is the process for manufacturing a nonwoven in which a web of fibers and/or filaments is consolidated a first time by projecting pressurized water jets thereat, by calendering or by needle bonding in order to obtain a web that has been consolidated a first time. The web that has been consolidated a first time, is drawn in the width direction, so as to obtain a widened web, then the widened web is consolidated a second time, preferably by projecting pressurized water jets thereat. The widened web is then dried, preferably by a drying device of adjustable width, downstream of the second consolidation.

Preferably the pressure of the jets of the second consolidation is higher than the pressure of the jets of the first consolidation. The pressure of the jets of the first consolidation may be, for example, between 15 and 70 bar and the pressure of the jets of the second consolidation may be greater than 70 bar and be, for example, between 75 and 100 bar. The projection holes for the jets may have a diameter in particular between 100 and 200 microns.

In order not to break the nonwovens, those having a weight less than or equal to 40 g/m$^2$ are drawn to an elongation of less than 30%, nonwovens having a weight greater than 40 g/m$^2$ but less than or equal to 60 g/m$^2$ are drawn to an elongation of less than 40% and nonwovens having a weight greater than 60 g/m$^2$ but less than or equal to 80 g/m$^2$ are drawn to an elongation of less than 50%. The percentage elongation is the ratio of the difference between the length after elongation less the length before elongation to the length before elongation.

Preferably, the temperature of the web that has been consolidated a first time is increased at least to 50° C. and at most to 300° C. The temperatures of the web before widening or during widening may be between 15° C. and 300° C. and, preferably, between 20° C. and 250° C. The heating phase is particularly important for a thermoplastic having a tendency to crystallize, like polyester, which is thus crystallized rapidly so that shrinkage is reduced. For polyolefins, heating causes softening that facilitates widening and reduces the individual diameters of the constituent filaments or fibers.

A subject of the invention is also a machine for manufacturing a nonwoven, comprising a means of transporting a web of fibers or of filaments into a device for consolidation by projection of water jets, by calendering or by needle bonding, characterized in that it comprises, downstream of the first consolidation device, a device for widening the firstly consolidated web. It is provided with a second consolidation device downstream of the widening device. Its effective consolidation width is greater than that of the first consolidation device. A nonwoven is obtained fulfilling the previously mentioned characteristics and having especially a large width, which reduces scrap when it is then cut into smaller width strips for the manufacture of the finished products.

The widening device, preferably of adjustable width, may comprise a widening roller and preferably a widening roller with spiral winding, or pin or clip tenters, especially in the case of heating.

These are flexible rotating rollers having a curvature radius that is adjusted according to the desired widening.

The widening of a wet nonwoven may also be obtained by two pin and chain tenters guided by a guidance system laterally to the edges of the nonwoven, and the gap between which tenters increases as the nonwoven advances.

The widening is facilitated if the conveying means comprises means so that the web speed is greater at the exit than at the entry of the widening device. Roller motors for driving the web may be provided at the entry and exit of the widening device and the rollers may be made to rotate at different speeds.

When this second consolidation device comprises projection of pressurized water jets, the water jet injection width of this second device is greater than that of the first device used for the first consolidation. But the second consolidation may also be carried out by thermobonding, calendering, needle bonding, by chemical or other means. The effective consolidation width of the second consolidation device is greater than that of the first consolidation device. The second consolidation device may also impart a pattern to the web.

Preferably, the second consolidation device is followed by an air suction drying device. Drying may especially be carried out at a temperature between 110 and 160° C. and is preferably carried out in a through-air oven. Preferably, positioned between the drying device and the second consolidation device is a device for dehumidifying by suction through a perforated surface, comprising means for controlling the working width of the perforated surface. This surface may be comprised of a suction belt connecting to a vacuum generator and fitted with slide valves.

Where appropriate, the widening and reconsolidation operations may be repeated several times.

In the appended figures, given only by way of example:

Figure 1:
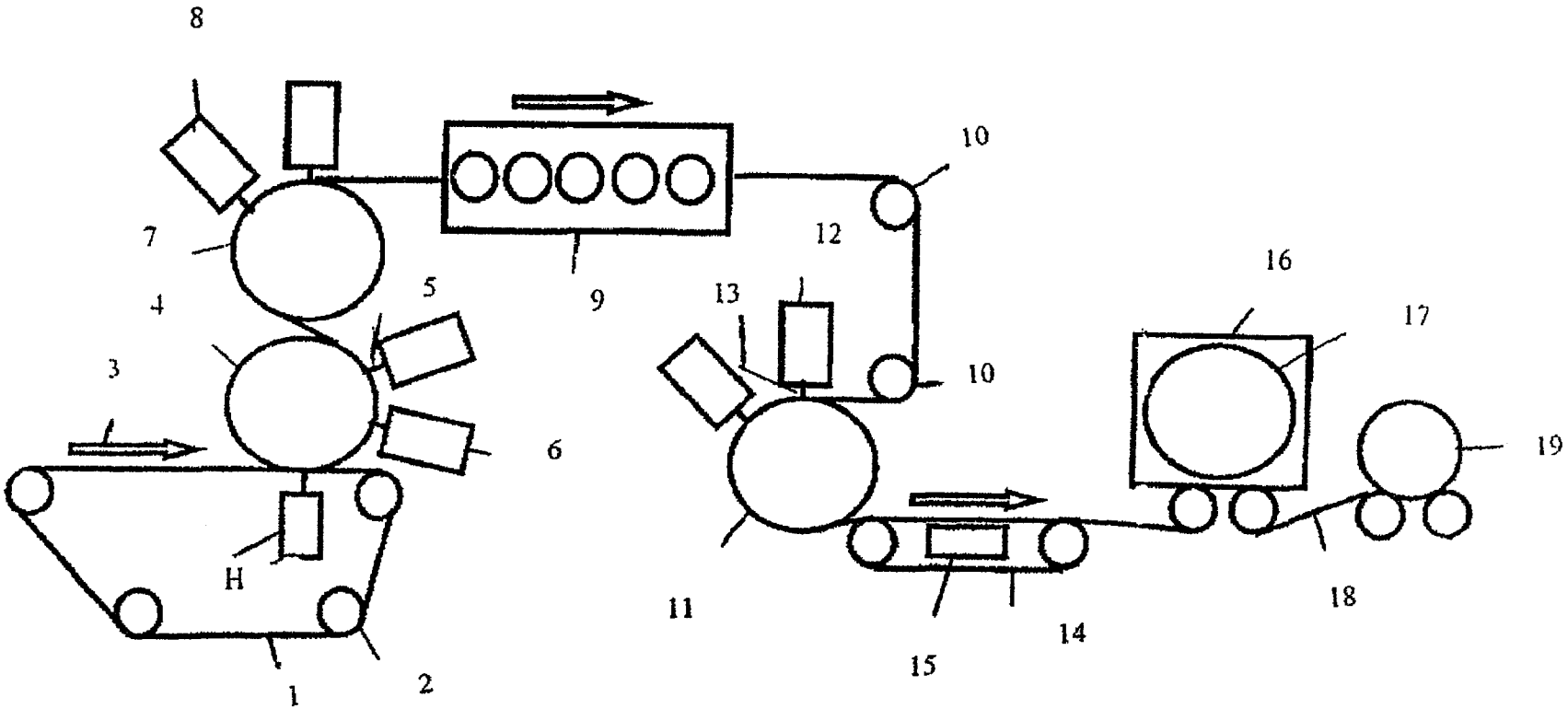
FIG. 1 is an outline of a machine for manufacturing a nonwoven according to the invention.

The machine shown in FIG. 1 comprises an entry belt conveyor 1, passing around the rollers 2 and conveying on the carrying side a web of fibers, shown by the arrow 3. The web is compacted between a drum 4 and the carrying side of the conveyor 1 with wetting by sending water through the conveyor 1 via a humidifier H before winding round the right-hand side of the drum where it meets, by way of the first consolidation, the pressurized water jets 5 originating from the injectors 6. The web consolidated in this way winds around another drum 7, itself also fitted with injectors 8 in order to complete what is known, in the sense of the invention, as the first consolidation.

The web that has been consolidated for the first time arrives at an entry speed at the two widening rollers 9 (separated by three return idlers) from which it leaves widened, at an exit speed that is greater than the entry speed because the drum 7 rotates less quickly than the rollers 10. The widened web is returned by the rollers 10 to a drum 11 fitted with injectors 12 projecting water jets 13 at the widened web in order to cause a second consolidation therein. The drum 11 is fitted with a casing that makes it possible to impart a pattern on the web that has been consolidated for the second time.

The web that has been consolidated for the second time passes on the carrying side of a conveyor 14 fitted with a suction chamber 15 underneath the carrying side so as to make a device for dehumidifying the web. At the exit of the conveyor 14, the web enters a circulating hot air oven 16 passing across a perforated surface 17 of which the length perpendicular to the plane of the drawing may be controlled so as to adapt to the width of the web. At the exit of the dryer the nonwoven 18 is wound around a winder 19.

Figure 2:
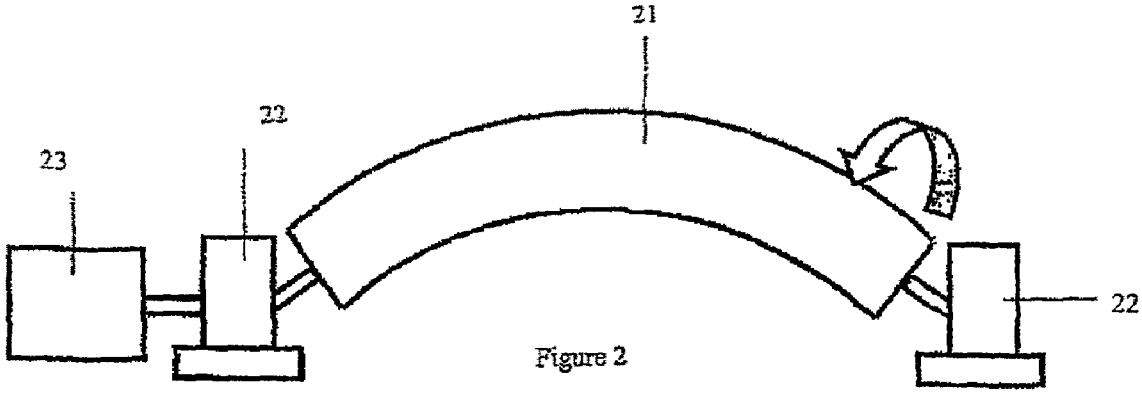
FIG. 2 is a view in elevation of a modified widening roller used in the machine according to another embodiment of the invention.
Figure 3:
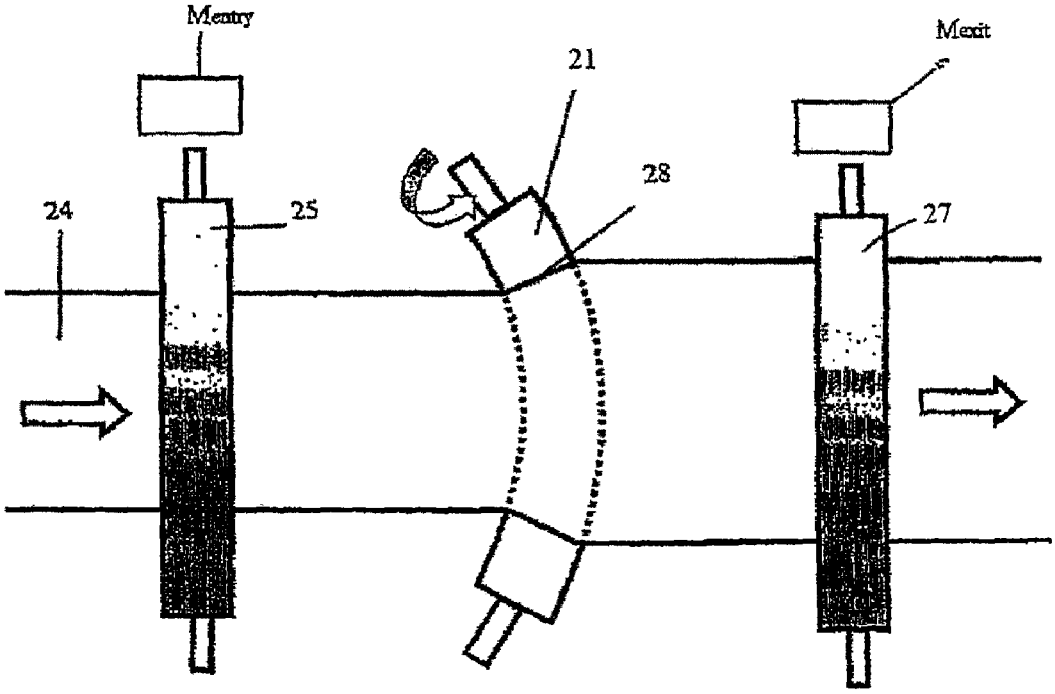
FIG. 3 is a top view of the modified widening roller of FIG. 2 together with the entry and exit roller assembly, and having parts omitted for clarity of illustration.

The widening roller 21 shown in FIGS. 2 and 3 is tensioned by the bearings 22 that have an adjustable internal device that makes it possible to modify the angle of the roller axes relative to the bearings, and therefore the curvature radius of the roller and also the percentage increase in the width of the nonwoven. For light nonwovens, of weights below 50 g/m$^2$, it is preferable to have a motor 23 that rotates the widening roller.

The nonwoven 24 is first realigned by a roller 25 having a motor $M_{entry}$, then is fed around the widening roller 21, then is again realigned by a roller 27 having a motor $M_{exit}$. At the periphery of the widening roller, the nonwoven follows a direction 28 perpendicular to the longitudinal axis of the roller 21. The surface of the roller 21 is covered preferably with a synthetic material to avoid slippage of the nonwoven at the roller surface so as to obtain maximum widening.

The laboratory tests for measuring the strength in the machine direction and in the cross direction and the weight per m$^2$ were conducted in accordance with the EDANA (European Disposables and Nonwovens Association) ERT standards, namely:

a) Weight per square meter:

A sample was conditioned for 24 hours and the test was carried out at 23° C. and at 50% relative humidity.

At least three samples with an area of at least 50 000 mm$^2$ were cut using a guillotine cutter.

Each sample was weighed on a laboratory balance having an accuracy of 0.1% of the weight of samples weighed.

b) Strength and elongation in the machine direction and in the cross direction:

A sample was conditioned for 24 hours and the test was carried out at 23° C. and at 50% relative humidity. A tensile testing machine was used for the test comprising a set of fixed jaws and a set of movable jaws moving at a constant rate. The jaws of the tensile testing machine had a working width of 50 mm. The tensile testing machine was equipped with a recorder that allowed the curve of the tensile force versus the elongation to be plotted. Five samples were cut out having a width of 50 mm±0.5 mm and length of 250 mm, this being in the machine direction and in the cross direction of the nonwoven. The samples were tested individually at a constant pull rate of 100 mm/min and with an initial distance between the jaws of 200 mm. The tensile testing machine recorded the curve of the tensile force in newtons versus the elongation.

The following examples illustrate the invention.

EXAMPLE 1 (COMPARATIVE EXAMPLE)

A web of about 60 g/m$^2$ composed of 50% viscose fibers of 1.7 dtex and 40 mm length and 50% polyester fibers of 1.7 dtex and 38 mm length was produced at a rate of 70 m/min by a carding machine of the type used for nonwovens. This web was delivered continuously to a first assembly for consolidation by water jets, followed by a second assembly for consolidation by water jets as shown in FIG. 1. The first consolidation point consisted of a conveyor for compacting and wetting the web followed by two rotating drums each equipped with two hydraulic injectors. The second consolidation point consisted of a rotating drum equipped with two hydraulic injectors.

At the first consolidation point, the web of fibers was first compacted between the transporting conveyor and the first drum. Immediately after compacting, the web was wetted and lightly consolidated by a hydraulic injector projecting 140 μm diameter water jets at a pressure of 15 bar. The jets being separated from one another by a distance of 0.8 mm over two rows.

The web compacted, wetted and lightly consolidated in this way was then subjected to the action of two successive hydraulic injectors projecting 120 μm diameter water jets and comprising 1666 jets/m of width at increasing pressures of 50 bar and 70 bar.

The nonwoven consolidated in this way was transferred to a second drum of the same type as the first that was also equipped with two hydraulic injectors projecting 120 μm diameter water jets and comprising 1666 jets/m of width at pressures of 70 bar each.

The wet nonwoven was then transferred to a final drum equipped with two hydraulic injectors projecting 120 μm diameter water jets and comprising 1666 jets/m of width at pressures of 80 bar each.

The nonwoven obtained in this way was then transferred onto a suction belt connected to a vacuum generator then dried at a temperature of 130° C. in a through-air oven.

A nonwoven was obtained weighing about 60 g/m$^2$.

The widening roller device positioned between the second drum and the third drum was inactive in this first example. The nonwoven therefore had in this example approximately the same width at all the water jet consolidation points.

EXAMPLE 2

The conditions used in example 1 were repeated but using the widening roller device positioned between the second and third drums. The width of the wet nonwoven was increased by 15% before being transferred to the third drum. The nonwoven was consolidated on the third drum under the same conditions used in example 1, that is to say by two hydraulic injectors at pressures of 80 bar each.

Then the nonwoven was dried as in example 1.

EXAMPLE 3

The conditions used in example 2 were repeated but this time applying a percentage widening of 30% before transferring the wet nonwoven to the third drum. The other test conditions were furthermore identical to those of test 2.

EXAMPLE 4 (COMPARATIVE EXAMPLE)

The conditions used in example 2 were repeated but this time applying a percentage widening of 50% before transferring the wet nonwoven to the third drum. The nonwoven tore along longitudinal lines. It could not be used. The test was stopped.

TABLE 1

| Characteristics | Units | Comparative example 1 | Example 2 | Example 3 |
|---|---|---|---|---|
| Weight per m$^2$ | g/m$^2$ | 60 | 52 | 43 |
| Strength in the machine direction | N/50 mm | 94 | 75 | 58 |

TABLE 1-continued

| Characteristics | Units | Comparative example 1 | Example 2 | Example 3 |
|---|---|---|---|---|
| Strength in the cross direction | N/50 mm | 26 | 29 | 26 |
| Elongation in the machine direction | % | 33 | 39 | 43 |
| Elongation in the cross direction | % | 121 | 95 | 89 |
| Longitudinal/ cross direction strength ratio | dimensionless | 3.61 | 2.58 | 2.23 |

The invention claimed is:

1. A machine for manufacturing a nonwoven comprising a means of transporting a web of fibers or of filaments into a first consolidation device having a first effective consolidation width for consolidation by water jets, by calendering or by needle bonding to form a consolidated web, and downstream of the first consolidation device, a device for widening the consolidated web and a second consolidation device that is placed downstream of the widening device and having a second effective consolidation width that is greater than the first effective consolidation width, and wherein the transporting means is further arranged to transport the web into the widening device at a web entry speed and from the widening device at a web exit speed that is greater than the web entry speed.

2. The machine as claimed in claim 1, wherein the widening device comprises at least one widening roller or pin or clip tenters.

3. The machine as claimed in claim 1, wherein the second consolidation device is a water jet consolidation device.

4. The machine as claimed in claim 1, wherein the second consolidation device is followed by a device for dehumidifying by suction through a perforated surface.

5. The machine as claimed in claim 1, wherein downstream of the second consolidation device, a drying device is provided.

6. The machine as claimed in claim 5, wherein the drying device is of adjustable width.

7. The machine as claimed in claim 2, wherein the widening device is of adjustable width.

* * * * *